United States Patent [19]

Scheffler et al.

[11] Patent Number: 4,664,526

[45] Date of Patent: May 12, 1987

[54] PROCESS AND APPARATUS FOR MIXING A LIQUID SAMPLE TO BE ANALYZED

[75] Inventors: Peter Scheffler, Henstedt-Ulzburg; Wilfried Mauser, Bad Schwartau; Thomas Grazianski, Hamburg, all of Fed. Rep. of Germany

[73] Assignees: Eppendorf Geratebau Netheler + Hinz GmbH, Hamburg, Fed. Rep. of Germany

[21] Appl. No.: 777,334

[22] Filed: Sep. 18, 1985

[30] Foreign Application Priority Data

Sep. 22, 1984 [DE] Fed. Rep. of Germany ..... 3434931

[51] Int. Cl.[4] ..... B01F 13/02

[52] U.S. Cl. ..... 366/106; 366/144; 261/81; 422/99

[58] Field of Search ..... 366/101, 106, 107, 108, 366/146, 144, 128, 348, 349; 422/99, 224; 261/81

[56] References Cited

U.S. PATENT DOCUMENTS

| | | | |
|---|---|---|---|
| 2,171,399 | 8/1939 | Hastert | 366/106 |
| 2,193,002 | 3/1940 | Shalom | 366/106 |
| 3,087,840 | 4/1963 | Shaw | 366/108 |
| 3,398,935 | 8/1968 | Livesey | 366/101 |
| 4,533,255 | 8/1985 | Gronholz et al. | 366/108 |

FOREIGN PATENT DOCUMENTS 1598514 11/1975 Fed. Rep. of Germany .

*Primary Examiner*—Robert W. Jenkins
*Attorney, Agent, or Firm*—Lane & Aitken

[57] ABSTRACT

A process for mixing a liquid sample to be analyzed with periodic air movements includes the steps of placing the sample in a sample container and alternately directing air jets onto different regions of the surface of the sample, wherein the air jets displace the surface regions and produce turbulence in the sample. An apparatus is provided for practicing the process.

14 Claims, 3 Drawing Figures

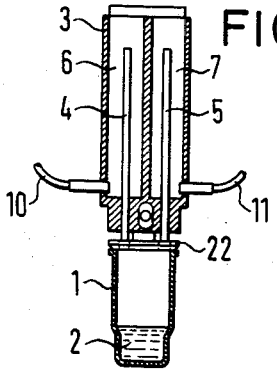
FIG. 3
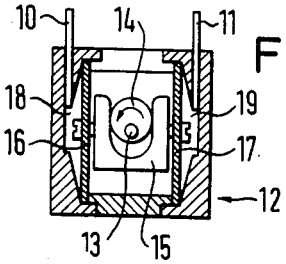
FIG. 2
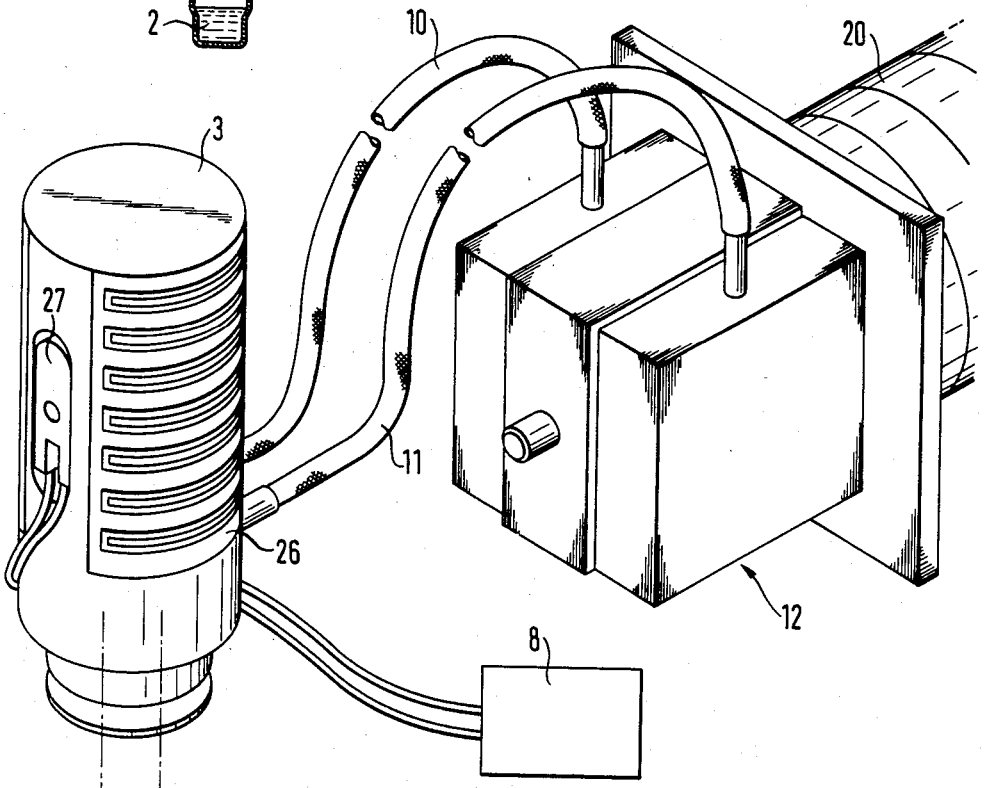
FIG. 1
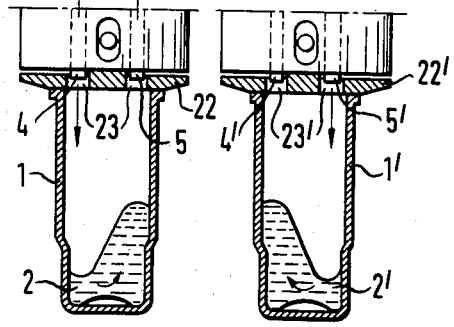

PROCESS AND APPARATUS FOR MIXING A LIQUID SAMPLE TO BE ANALYZED

BACKGROUND OF THE INVENTION

1. Field of the Invention

The invention relates to a process for mixing a liquid sample to be analyzed, in which the liquid sample is placed in a sample container, particularly a cell, and is mixed by a periodic air movement.

The invention also relates to an apparatus for mixing a liquid sample to be analyzed in a sample container, particularly a cell, in which an air movement can be produced above the sample surface.

2. Description of the Related Art

In known processes and apparatuses of this type (European Patent Application No. 0 098 949 and West German Offenlegungsschrift No. 15 98 514), the sample container is sealed and the air column between the seal and the sample surface is subjected to periodic vibrations or oscillations, so that the liquid sample in the sample container is periodically oscillated and consequently mixed either by deforming an elastic container wall or by moving the sample backwards and forwards between the two legs of the U-shaped sample container, whereof one leg is sealed in the aforementioned manner and whereof the other leg is open.

Thus in the known process, it is necessary to seal the sample container in order to be able to periodically oscillate an air column above the sample surface. This is not only relatively complicated, but also leads to sealing problems. In addition, special sample containers are required, which are either U-shaped or have an elastically deformable wall.

The problem of the present invention is to provide a simple process and a simple apparatus for mixing a liquid sample to be analyzed in a standard container, with the aid of which a contact-free mixing takes place without sealing problems occurring.

SUMMARY OF THE INVENTION

According to the invention, this problem is solved in the case of a process of the aforementioned type in that air jets are alternately directed onto different regions of the sample surrace to thereby displace the particular sample surface regions and produce turbulence in the liquid sample, the air jets preferably having a higher temperature than the sample liquid.

Thus, in the process according to the invention, the movement and consequently the thorough mixing of the sample liquid takes place solely through air jets being alternately directed onto different surface regions of the samples and through a wavy movement being imparted to the sample liquid, so that turbulence is produced leading to a rapid and complete mixing of the sample. There is no need for the performance of this mixing process to seal the sample container, which is in one embodiment a standard container with a single liquid column, and/or no need to bring large parts of the device with which the air jets are directed onto the sample surface into contact with the sample container or sample, so that an effective and rapid mixing of the liquid sample is achieved in a simple manner.

It is necessary in many cases to keep the liquid sample at a constant temperature both during the mixing process and during the analysis, and due to the fact that the air jets have a higher temperature than the sample liquid, it is ensured that the air of the air jets coming into contact with the sample liquid does not cool the liquid sample as a result of an evaporation action.

Evaporation of the sample liquid when carrying out the mixing process is additionally reduced in one embodiment in that the air used for the air jets has an atmospheric humidity of approximately 100%, so that said saturated air does not absorb any moisture from the sample liquid.

It has been found that a particularly good mixing action is obtained if the air jets are directed onto the sample surface in the form of laminar flows, because there is then a particularly good transfer of momentum from the air jets to the sample liquid.

The problem of the invention is also solved with an apparatus of the aforementioned type by at least two air ducts or passages positioned with their outlets above the sample container and which are connected to pumping means alternately applying air pulses thereto.

As described hereinbefore, in connection with the process according to the invention, such an apparatus makes it possible to mix a liquid sample to be analyzed in a very simple manner without it being necessary to seal the sample container opening and without there having to be a contact between parts of the apparatus and the sample container and/or the liquid sample.

It has been found that a particularly effective, rapid mixing of a liquid sample is achieved if the pumping means operates at a frequency of 9 to 14 Hz.

In order to warm the air for the air jets to a temperature above the sample liquid temperature, the air to be supplied to the air passages, in one embodiment, passes through a temperature control or tempering chamber which can be heated in a regulated manner.

In order to moisten the air to be supplied to the air openings, it is in one embodiment passed through a humidifier, which can e.g. comprise a water dish or tray on the bottom of the tempering chamber over which dish or tray the air is passed.

As it has been found that the mixing process takes place in a very favorable manner if the air jets consist of laminar flows, the length and inside diameter of the air openings are selected in one embodiment in such a way that laminar air flows pass out of the same.

In order to keep low the external air proportion from the ambient air coming into contact with the sample surface, the sample container is in one embodiment covered with a cover having air openings for the passage of the air jets, e.g. in the form of a foil fixed to the sample container or a resilient covering mounted on the apparatus.

BRIEF DESCRIPTION OF THE DRAWINGS

The invention is described in greater detail hereinafter relative to the drawings.

FIG. 1 is a partly broken-away, diagrammatic, partial view of an apparatus for mixing a liquid sample, located in a sample container.

FIG. 2 is in section a basic diagram of the pump used in FIG. 1.

FIG. 3 is a simplified sectional view of the tempering chamber with the air passages above a sample container containing a liquid sample.

DESCRIPTION OF THE PREFERRED EMBODIMENT

The apparatus shown contains a temperature control or tempering chamber 3 and a pump 12 driven by a drive 20, which pump is connected via connecting hoses 10, 11, to the tempering chamber 3.

As can be seen in FIG. 2, pump 12 has two pump chambers 18, 19, which are in each case closed with a diaphragm 16, 17. An actuating part 15 is fixed by means of screws to diaphragms 16, 17, and is provided with a slot, in which extends a cam 14. This cam is located on a shaft 13, driven by the drive 20 and is rotated in the direction of the arrow shown in FIG. 2.

The connecting hoses 10, 11 are in each case connected to one of the chambers 18, 19 and extend in tempering chamber 3 into sectional chambers 6, 7 at a limited distance above the bottom thereof. Through said bottoms the air passages 4, 5 extend downwards out of the tempering chamber 3, whilst the upper ends of the air passages 4, 5 terminate well above the connections for the connecting hoses 10, 11 in sectional chambers 6, 7.

Tempering chamber 3 is surrounded by an electrical heating jacket 26 and in its wall is located a temperature sensor 27, with the aid of which and by means of a diagrammatically represented thermostat 8, the heating of the tempering chamber is chosen in such a way that in the sectional chambers 6, 7 the desired temperature is maintained.

The air passages 4, 5 are removed at the bottom from tempering chamber 3 in such a way that, on positioning a sample container 1 below the outlet of air passages 4, 5, they are located in the vicinity of the internal opening diameter of container 1, but at a maximum distance from one another, whereas the sample container 1 is covered by a covering 22 held resiliently on the tempering chamber 3, which covering has openings 23 for the air jets.

In operation, drive 20 drives shaft 13 and consequently rotates cam 14, so that periodically air is compressed in chambers 18, 19 of FIG. 2 and is consequently displaced therefrom. Thereby, such air is forced via connecting hoses 10, 11 into sectional chambers 6, 7. There is in one embodiment water on the bottom of the sectional chambers, so that the air supplied thereto flows over said water and is humidified, whilst the air in the sectional chambers 6, 7 is also heated to a temperature above the temperature of the sample to be mixed.

As a result of the increased pressure in the sectional chambers 6, 7, during the supply of air pulses from chambers 18, 19, air is correspondingly forced downwards through air passages 4, 5, i.e. air jets pass alternately out of said passages 4, 5 and their frequency and duration are dependent on the construction and operation of pump 12. It is pointed out that when air is being forced out from one of the air passages, air is being sucked back via the other air passage into the associated sectional chamber and via the connecting hose into the associated pump chamber closed by a diaphragm.

The dimensions of air passages 4, 5 are preferably selected in such a way that laminar flows pass out of the same. According to an embodiment, air passages with a length of 40 mm and an internal diameter of 0.8 mm are used for a discharge velocity of the air jets of 1 to 2 m/sec and a volume of 5 to 10 $cm^3$/sec. The resulting laminar flow led to an effective thorough mixing when the outlet ends of the air passages 4,5 were 21 to 30 mm above the sample surface.

When the apparatus is in operation, a sample container 1, e.g. a cell containing the liquid sample 2 to be mixed is placed under air passages 4, 5, as indicated in FIGS. 1 and 3. When an air jet indicated by an arrow in FIG. 1 passes out of air passage 4, then the surface of the sample liquid 2 is deformed in the indicated manner, whereas, when an air jet passes out of the other air passage, indicated for this purpose as 5' in FIG. 1 and represented in laterally displaced form, said air jet brings about a deformation of the liquid sample surface 2' in the laterally displaced sample container 1', which is identical to the sample container 1, cf. FIG. 1. Thus, there is alternately a deformation of the liquid sample surface in conjunction with the turbulence indicated by the curved arrows in accordance with FIG. 1, which leads to a rapid, effective, thorough mixing of the liquid sample. Due to the increased temperature and the high atmospheric humidity of the air jets, neither a temperature change nor a liquid loss in the liquid sample need be feared.

We claim:

1. A process for mixing a liquid sample to be analyzed comprising a first step of placing the liquid sample in a sample container and a second step of alternately directing air jets onto different regions of a surface of said sample, wherein said air jets displace said sample surface regions and produce turbulence in said sample such that periodic air movement mixes said sample.

2. The process according to claim 1, further comprising the step of warming air forming said air jets to a temperature above a temperature of said sample liquid.

3. The process according to claim 1 or 2, further comprising the step of moisturizing air forming said air jets to an atmospheric humidity of approximately 100%.

4. The process according to claim 1 or 2, wherein said second step comprises the step of directing said air jets onto said sample surface in the form of laminar flows.

5. An apparatus for mixing a liquid sample to be analyzed comprising a sample container for holding said liquid sample, at least two air passages having outlets positioned above said sample container, a pumping means which is connected to said air passages and which alternately applies air pulses to said passages, wherein said air passages are adapted to produce an air movement above a surface of said sample, and a tempering chamber, wherein air to be supplied to said air passages passes through said tempering chamber, whereupon said air is heated in a regulated manner.

6. The apparatus of claim 5 wherein said sample container is a cell.

7. The apparatus according to claim 5 wherein said pumping means operates with a frequency of 9 to 14 Hz.

8. The apparatus according to claim 5, further comprising a humidifier, wherein air to be supplied to said air passages passes through said humidifier.

9. The apparatus according to claim 8, further comprising a humidifier, wherein air to be supplied to said air passages passes through said humidifier.

10. The apparatus aooording to claim 9 wherein said humidifier comprises a water tray located on the bottom of said tempering chamber, said tray being disposed such that air passing through said tempering chamber passes over said tray.

11. The apparatus according to claim 5 wherein the length and internal diameter of said air passages are selected such that air passing out of said passages is in the form of laminar air flows.

12. The apparatus according to claim 5, further comprising a covering for said sample container, said covering defining air openings.

13. An apparatus for mixing a liquid sample to be analyzed comprising a sample container for holding said liquid sample, at least two air passages having outlets positioned above said sample container, and a pumping means which is connected to said air passages and which alternately applies air pulses to said passages, wherein said air passages are adapted to produce an air movement above a surface of said sample, said air passages having a length and internal diameter such that air passing out of said passages is in the form of laminar air flows.

14. An apparatus for mixing a liquid sample to be analyzed comprising a sample container for holding said liquid sample, at least two air passages having outlets positioned above said sample container, a pumping means which is connected to said passages and which alternately applies air pulses to said passages, wherein said air passages are adapted to produce an air movement above a surface of said sample, and a covering for said sample container, said covering defining air openings in register with said air passage outlets.

* * * * *